US009475286B2

(12) United States Patent
Tuttnauer et al.

(10) Patent No.: US 9,475,286 B2
(45) Date of Patent: Oct. 25, 2016

(54) CROSS-TALK SUPPRESSION OF ADJACENT INKJET NOZZLES

(71) Applicant: Hewlett-Packard Industrial Printing LTD., Fort Collins, CO (US)

(72) Inventors: Ron Tuttnauer, Netanya (IL); Dan Bavli, Netanya (IL); Etgar Marcus, Yoqneam (IL); Mark Ripenbein, Netanya (IL)

(73) Assignee: HEWLETT-PACKARD INDUSTRIAL PRINTING LTD, Netanya (IL)

( * ) Notice: Subject to any disclaimer, the term of this patent is extended or adjusted under 35 U.S.C. 154(b) by 0 days.

(21) Appl. No.: 14/784,277

(22) PCT Filed: Apr. 23, 2013

(86) PCT No.: PCT/IL2013/050348

§ 371 (c)(1),
(2) Date: Oct. 13, 2015

(87) PCT Pub. No.: WO2014/174503

PCT Pub. Date: Oct. 30, 2014

(65) Prior Publication Data

US 2016/0059548 A1 Mar. 3, 2016

(51) Int. Cl.
*B41J 2/045* (2006.01)

(52) U.S. Cl.
CPC ..... *B41J 2/04573* (2013.01); *B41J 2/04525* (2013.01); *B41J 2/04586* (2013.01)

(58) Field of Classification Search
CPC ..... B41J 2/04525; B41J 2/04568; B41J 2/04573; B41J 2/04586
See application file for complete search history.

(56) References Cited

U.S. PATENT DOCUMENTS

| | | | | |
|---|---|---|---|---|
| 5,142,296 | A | 8/1992 | Lopez et al. | |
| 5,724,077 | A | 3/1998 | Murata | |
| 5,801,732 | A | 9/1998 | Pengelly | |
| 6,286,925 | B1 | 9/2001 | Heinzl et al. | |
| 6,533,382 | B1 * | 3/2003 | Tomida | B41J 2/2114 347/15 |
| 6,719,390 | B1 | 4/2004 | Howkins | |
| 7,267,416 | B2 * | 9/2007 | Iriguchi | B41J 2/04573 347/12 |
| 7,303,260 | B2 * | 12/2007 | Osada | B41J 2/1404 347/47 |
| 8,191,995 | B2 * | 6/2012 | Lee | B41J 2/15 347/57 |
| 8,757,750 | B2 * | 6/2014 | Banerjee | B41J 2/04525 347/10 |
| 2011/0157281 | A1 | 6/2011 | Lee | |
| 2012/0120138 | A1 | 5/2012 | Banerjee et al. | |

FOREIGN PATENT DOCUMENTS

| | | |
|---|---|---|
| CN | 1769055 | 5/2006 |
| CN | 102218909 | 10/2011 |
| CN | 102689510 | 9/2012 |

(Continued)

OTHER PUBLICATIONS

Jong et al; Entrapped Air Bubbles in Piezo-driven Inkjet Printing their Effect on the Droplet Velocity; Physics of Fluids; Dec. 8, 2006; vol. 18, Issue 12.

*Primary Examiner* — Ahn T. N. Vo
(74) *Attorney, Agent, or Firm* — Fabian Van Cott

(57) ABSTRACT

A method of cross-talk suppression and a system therein are disclosed. The method may include receiving a print pulse to simultaneously fire ink from an array of adjacent nozzles of an inkjet printhead; and actuating groups of three or more adjacent nozzles of said array of nozzles with a time delay between actuations of said three or more nozzles of the groups.

20 Claims, 8 Drawing Sheets

(56) References Cited

FOREIGN PATENT DOCUMENTS

| | | |
|---|---|---|
| CN | 102781671 | 11/2012 |
| CN | 102781673 | 11/2012 |
| EP | 0897804 | 2/1999 |
| EP | 1652669 | 5/2006 |
| JP | 2001287347 | 10/2001 |
| WO | WO-2011112200 | 9/2011 |

* cited by examiner

200

CROSS-TALK SUPPRESSION OF ADJACENT INKJET NOZZLES

BACKGROUND

Typically, an inkjet printer includes one or a plurality of printheads. Ink is supplied to the printheads and is ejected through ink injectors, which are also referred to as nozzles, onto a print medium (e.g. paper, cardboard, etc.). The ejection of ink is controlled by a controller that can separately control each nozzle. Inkjet printhead nozzles may be arranged in an array or a plurality of arrays of nozzles. The ejection of ink through a nozzle is facilitated by a corresponding actuator.

Typically, a printhead includes a plurality of nozzles and corresponding actuators, each actuator located adjacent to and governing the ejection of ink through a corresponding nozzle. Operating an actuator, e.g. a piezoelectric actuator, causes a droplet of ink to be ejected through the adjacent nozzle.

SUMMARY

There is thus provided, in accordance with some examples, a method of cross-talk suppression of adjacent inkjet nozzles. The method may include receiving a print pulse to simultaneously fire ink from an array of adjacent nozzles of an inkjet printhead. The method may also include actuating groups of three or more adjacent nozzles of said array of nozzles with a time delay between actuations of said three or more nozzles of the groups.

Furthermore, according to some examples, there is provided a system that includes an array of adjacent nozzles of an inkjet printhead, configured, upon receiving a print pulse to simultaneously fire ink from the array of adjacent nozzles, to actuate groups of three or more adjacent nozzles of said array of nozzles with a time delay between actuations of said three or more nozzles of the groups.

BRIEF DESCRIPTION OF THE DRAWINGS

In order to better illustrate examples, the following figures are provided and referenced hereafter. It should be noted that the figures are given as examples only and in no way limit the scope of the present disclosure. It will be appreciated that for simplicity and clarity of illustration, elements shown in the figures have not necessarily been drawn to scale. For example, the dimensions of some of the elements may be exaggerated relative to other elements for clarity. Like components are denoted by like reference numerals.

DETAILED DESCRIPTION

In the following detailed description, numerous specific details are set forth in order to provide a thorough understanding of the methods and systems. However, it will be understood by those skilled in the art that the present methods and systems may be practiced without these specific details. In other instances, well-known methods, procedures, and components have not been described in detail so as not to obscure the present methods and systems.

Although the examples disclosed and discussed herein are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence. Additionally, some of the described method examples or elements thereof can occur or be performed at the same point in time.

Unless specifically stated otherwise, as apparent from the following discussions, it is appreciated that throughout the specification, discussions utilizing terms such as "adding", "associating" "selecting," "evaluating," "processing," "computing," "calculating," "determining," "designating," "allocating" or the like, refer to the actions and/or processes of a computer, computer processor or computing system, or similar electronic computing device, that manipulate, execute and/or transform data represented as physical, such as electronic, quantities within the computing system's registers and/or memories into other data similarly represented as physical quantities within the computing system's memories, registers or other such information storage, transmission or display devices.

Figure 1:
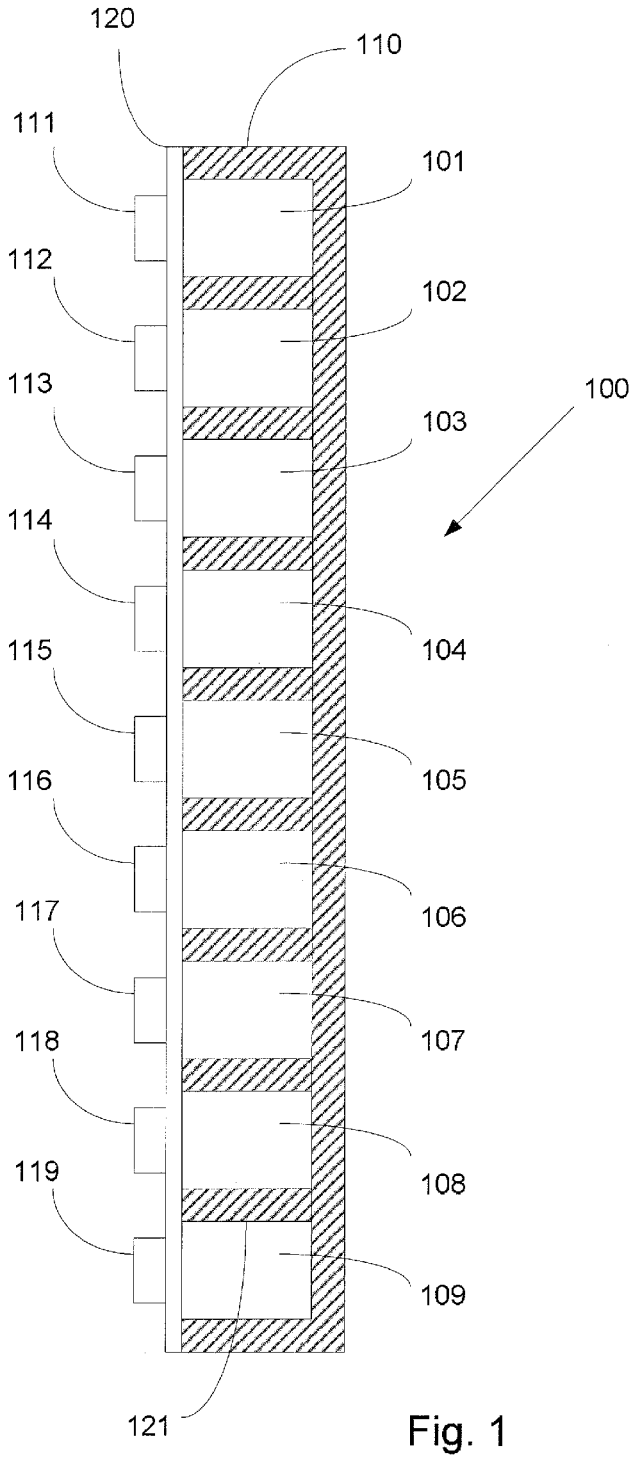
FIG. 1 illustrates a segment of a printhead, according to examples.

FIG. 1 illustrates a segment of a printhead, according to examples;

A printhead may include one or a plurality of ink nozzle arrays. In the example shown in FIG. 1, printhead 100 includes an array of ink nozzles (101-109 in this example) and corresponding actuators (111-119). Each actuator is provided to actuate the nozzle it is adjacent to. Each nozzle is designed to eject ink from within the adjacent ink chamber, which is defined by its surrounding walls. In some examples a printhead may include a MEMS (Micro-Electro-Mechanical System) structure 110, which includes internal cavities defined by partitions 121. In some examples a thin flexible sheet (e.g. a glass sheet 120) is provided over the MEMS structure 110, and piezoelectric actuators 111-119 are mounted over the flexible sheet adjacent to the cavities so as to actuate their respective nozzles 101-109.

When the piezoelectric actuator is energized it causes a fluctuation of a corresponding adjacent portion of the flexible sheet to fluctuate, causing an ink droplet to emerge through the nozzle. The size of the droplet may be, for example, determined by controlling the velocity of the ink droplet as it is ejected from the nozzle, thus, in some examples a specific actuation pulse-pattern is employed to control the ink droplet size and ejection timing (e.g. two or more rapid actuation pulses). By controlling the actuation pulse pattern ink droplets of different sizes may be produced from each nozzle.

Although in principle each nozzle of the printhead is operated separately by its corresponding actuator, when operating simultaneously adjacent nozzles cross-talk may occur, which affects the performance of the printhead and degrades the print quality.

There may be several kinds of inherent crosstalk effects, for example, mechanical, electrical and fluidically-oriented crosstalk effects. The largest influence of cross-talk is typically on a single ejected droplet. The nominal velocity of the ejected droplets in some examples may be a few meters per second (e.g. about 8 m/sec) and it is estimated that the deviation from the nominal velocity of a single droplet could be as large as 25% due to cross-talk. Under similar crosstalk conditions the deviation from the nominal velocity could be up to about 15% and 11% for double-sized and triple-sized ink droplets respectively.

The crosstalk phenomenon may cause discrepancies not only in the ejection velocity of ink droplets, but also in their weight and shape. Ejection velocity variances would typically result in dot placement error (DPE) with respect to the desired or nominal location, with the largest dot placements error occurring for a single drop. This affects image quality. The produced print is likely to look grainy, lines wavy, text broken and limited to a certain minimum size, below which blur would make it illegible.

Experimental measurements show that at a distance of 2 mm between the printed substrate and the printhead, which is a common spacing in the industrial printing realm, and substrate velocity of 1.8 m/sec, the DPE per a single drop could be about 150 microns and the droplet velocity could be reduced from a nominal speed of 8 m/sec down to 6 m/sec. in a 600 dpi print, this translates into a 3.5 pixels placement error.

Crosstalk can be decreased by reducing the number of adjacent orifices actuated simultaneously. A know approach involves positioning adjacent nozzles in an offset step-wise alignment, such that the distance between adjacent nozzles is increased with respect to a corresponding linear alignment of the nozzles, the firing of adjacent nozzles is delayed to compensate for the distance between adjacent nozzles in order to obtain a linearly aligned print formation. Another solution involves masking the printed bitmap so that adjacent orifices will not fire simultaneously. Such a solution may typically bring about the need to compensate by adding more printing passes and thus lowering overall throughput. Other known schemes involve compensation by varying the actuator drive voltage, but their implementation seem to be costly and complex. There also exist a two-phase shift between filing of adjacent nozzles in which every other nozzle is delayed with respect to its adjacent nozzle in an interlaced manner. The latter solution appears to be useful in reducing cross-talk attributed to mechanical causes.

Figure 2:
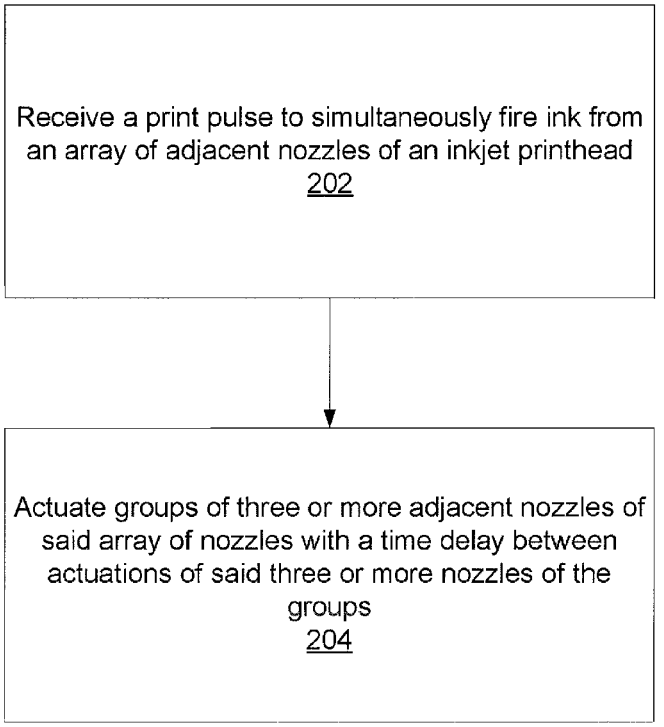
FIG. 2 illustrates a method for inkjet cross-talk suppression, according to examples.

FIG. 2 illustrates a method 200 of cross-talk suppression of adjacent inkjet nozzles, according to examples.

A method of inkjet cross-talk suppression, according to examples, may include receiving 202 a print pulse to simultaneously fire ink from an array of adjacent nozzles of an inkjet printhead and actuating 204 groups of three or more adjacent nozzles of said array of nozzles with a time delay between actuations of said three or more nozzles of the groups.

A "print pulse", in the context of the present disclosure, and according to examples, refers to a print command which is dictated by the printer processor, and corresponds to the content of the image to be printed. A "print pulse to simultaneously fire ink from an array of adjacent nozzles" would be generated by the processor of the printer when the image dictates ink to be deposited on the substrate to be printed directly opposite the printhead location at an instance.

Actuating, upon receipt of a print pulse to simultaneously fire ink from an array of adjacent nozzles, while separating the firing instances of three or more adjacent nozzles has been found to greatly suppress cross-talk between adjacent nozzles.

Figure 3A:
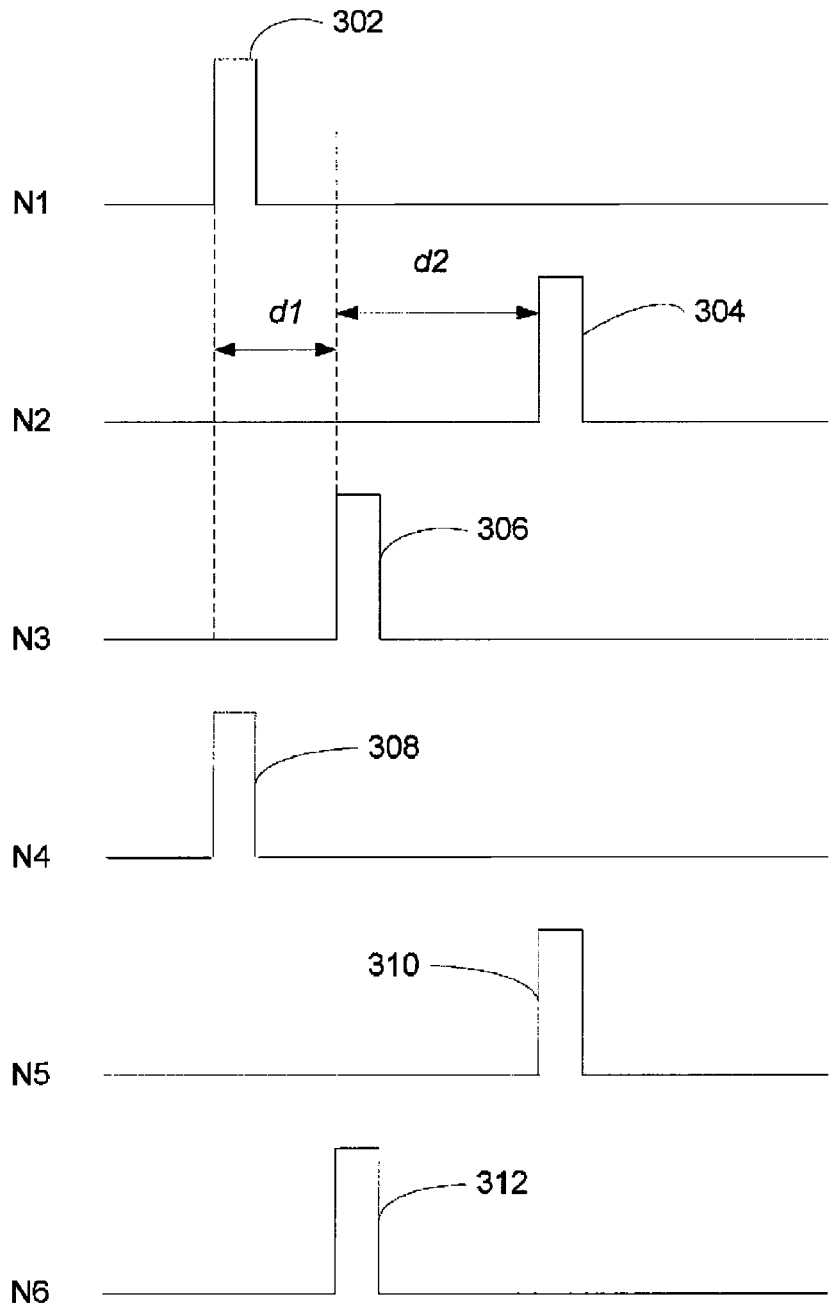
FIG. 3A illustrates an actuation pulse pattern for groups of three adjacent nozzles in an array of a plurality of adjacent nozzles, according to examples.

FIG. 3A illustrates an actuation pulse pattern for groups of three adjacent nozzles in an array of a plurality of adjacent nozzles, according to examples. In this example the actuation pulse pattern is shown for 6 adjacent nozzles (N1-N6) representing a linearly aligned and is configured to actuate the nozzles in groups of three adjacent nozzles (N1-N3 and N4-N6). The horizontal axis of each actuation pulse marks time, whereas the vertical axis relates to the amplitude of each pulse.

According to examples the actuation pulse pattern includes firing N1, N2 and N3 with a time delay between them, so that the firing instances of these actuators are separated. Similarly, the actuation pulse pattern for actuators N4-N6 causes them to fire separately with a time delay between them. Thus actuation pulses 302 and 308 actuate simultaneously nozzles N1 and N4, actuation pulses 304 and 310 actuate simultaneously nozzles N2 and N5, and actuation pulses 306 and 312 actuate simultaneously nozzles N3 and N6, while maintaining time delays d1 and d2 between these actuations. Typically d1 and d2 are equal or substantially equal time intervals, but in some examples the time delays between different actuation pulses within a group of adjacent nozzles may vary. In some examples the time delay would be determined with relation to the nature of the printing job at hand, required resolution and/or required printing speed.

The delays create temporal distinction between adjacent nozzles, thus significantly suppressing cross-talk (supposedly mainly fluidic cross-talk, which significantly contributes to the overall cross-talk phenomenon).

A time delay may typically be a fraction of the delay between consecutive firings of the same nozzle. For example, if the firing frequency of the nozzles of a printhead is about 30 kHz, than the time delay between firings of adjacent nozzles in a group of nozzles according to examples, may be selected to be of a few micro-seconds (e.g. in the range of 3-7 micro-seconds, such as, for example 5 micro-seconds etc.), so as to allow some damping period between successive firings by the same nozzle. Generally, according to examples, for a group of n adjacent nozzles which operate each at a firing frequency f per second the time delay between firings of adjacent nozzles in that group of nozzles may satisfy the relation $$d = \frac{1}{f \cdot n \cdot k},$$

where k is greater than 1. In fact, k is a factor which may be chosen to determine the length of the damping period between successive firings by the same nozzle (the greater k is the greater the damping period). Damping may be required to allow the nozzles to regain stability before the next consecutive firing.

The time delay may be fine-tuned so that crosstalk and drop velocity differences between adjacent nozzles are minimized. According to examples, the time delay is a configurable value which may be determined based on lab test results that simulate extreme cases of crosstalk. In some examples, the time delay may be fine tuned online. When choosing the length of the a relative displacement time delay between firings of adjacent nozzles in a group of nozzles according to examples, the relative velocity between the array of adjacent nozzles (e.g. the printhead) and the substrate on which the array of adjacent nozzles is to print may be taken into account. The time delay, by definition, is inserting a small drop placement error governed by the relative velocity. The chosen time delay value will be a balance between the positive effect of it on crosstalk and its negative effect on drop placement error The time delay between simultaneous actuations of nozzles of different groups may typically be constant but it may also vary.

Figure 3B:
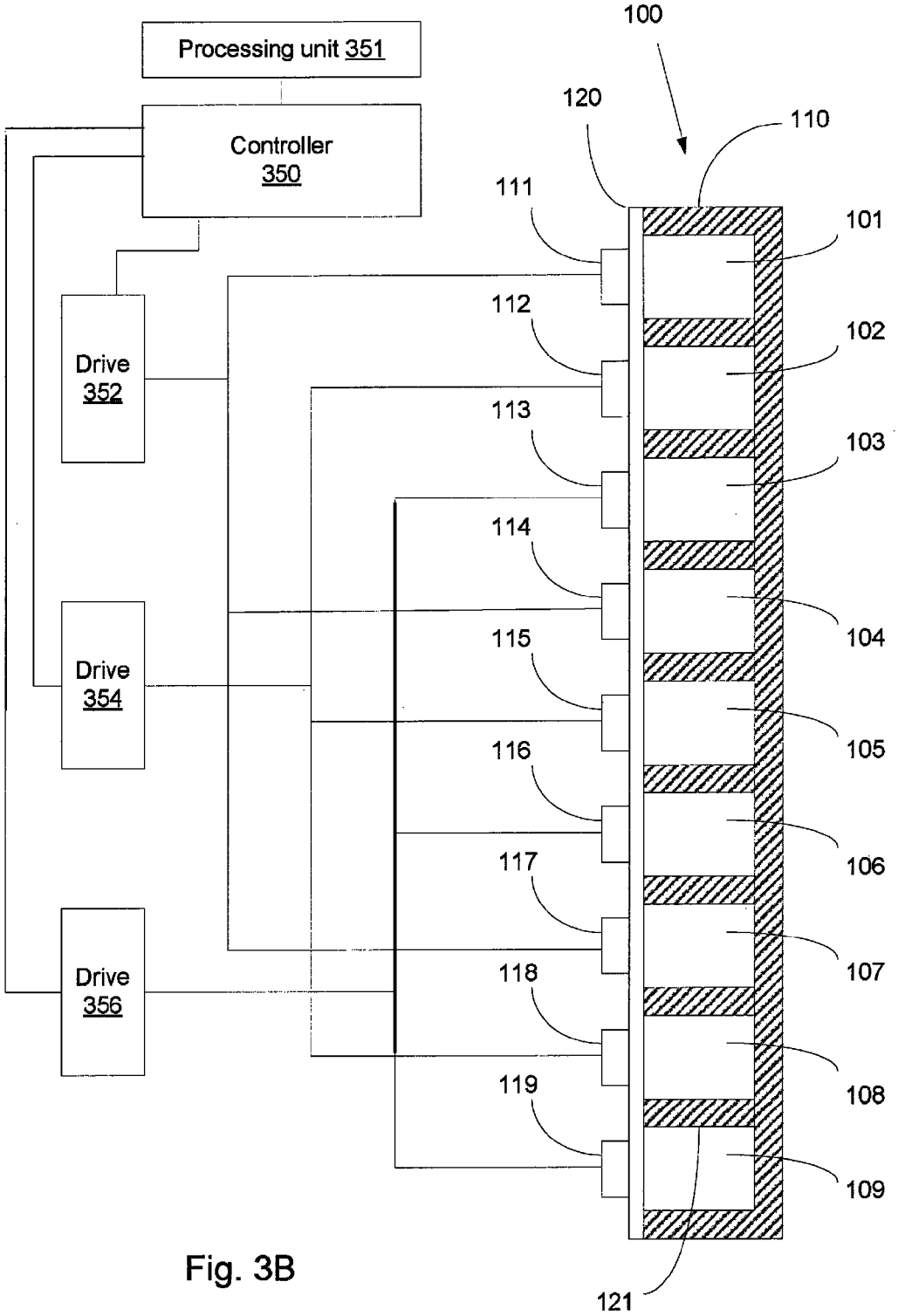
FIG. 3B illustrates a control scheme for operating groups of three adjacent nozzles in an array of a plurality of adjacent nozzles, according to examples.

FIG. 3B illustrates a control scheme for operating groups of three adjacent nozzles in an array of a plurality of adjacent nozzles, according to examples.

In this example three drivers 352, 354, and 356 are used to drive in parallel corresponding nozzles of different groups of adjacent nozzles. A print pulse to simultaneously fire ink from array 100 of adjacent nozzles 101-109 may be issued from processing unit 351 and forwarded to controller 350, which controls the operation of drivers 352, 354, and 356. Drive 352 may be used to actuate the first actuators 111, 114 and 117 of the groups of three adjacent actuators, drive 354 may be used to actuate the second actuators 112, 115 and 118 of the groups of three adjacent actuators, and drive 356 may be used to actuate the third actuators 113, 116 and 119 of the groups of three adjacent actuators, causing nozzles the first, the second and the third nozzles of each group of adjacent nozzles (101, 104 and 107, 102, 105 and 108, and 103, 106 and 109 respectively) to operate simultaneously, while affecting a time delay between the firing of the first nozzles of the groups, the second nozzles of the groups and from the third nozzles of the groups.

Figure 4A:
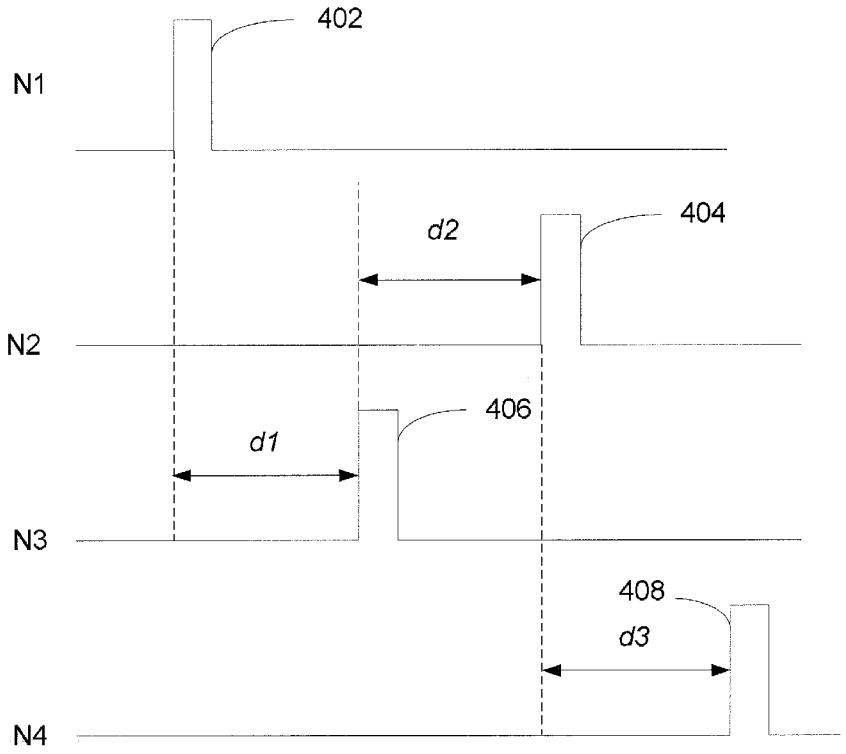
FIG. 4A illustrates an actuation pulse pattern for a group of four adjacent nozzles in an array of a plurality of adjacent nozzles, according to examples.

FIG. 4A illustrates an actuation pulse pattern for a group of four adjacent nozzles in an array of a plurality of adjacent nozzles, according to examples. In this example the nozzles of the nozzle array are grouped in fours. In this example the nozzles of the array of adjacent nozzles are grouped into groups of four nozzles. Shown in the actuation pulse pattern for a single group of adjacent actuators N1-N4. This pattern may be repeated for the other groups of adjacent nozzles of that array of adjacent nozzles. The first, second, third and fourth adjacent nozzles (N1-N4) are separately actuated in response to receiving a print pulse to simultaneously fire ink from the array of adjacent nozzles. Similarly each first, second, third and fourth adjacent nozzles of the other groups of four nozzles are separately actuated by a sequence of actuation pulses 402, 406, 404 and 408 (in that chronological order) in response to receiving the print pulse. Time delays d1, d2 and d3 are maintained between the actuations of the four nozzles of each group. Time delays d1, d2 and d3 may typically be of the same length but may also vary in some examples. At the same time, the first nozzles of each group of four nozzles are fired simultaneously and so are the second nozzles of each group of four nozzles, the third nozzles of each group of four nozzles and the fourth nozzles of each group of four nozzles.

The order of actuation within a group of adjacent nozzles may be selected from a variety of combinations. For example, when selecting the first nozzle to fire first and then firing the third nozzle, then firing the second nozzle and completing the firing cycle for that group by firing the fourth nozzle makes the delay between firings of adjacent nozzles greater than in the case when the nozzles of the group are fired consecutively in their order of position (1-2-3-4). Thus firing the adjacent nozzles of a group of nozzles in an order which is different than the position order may increase the effectiveness of cross-talk suppression.

Figure 4B:
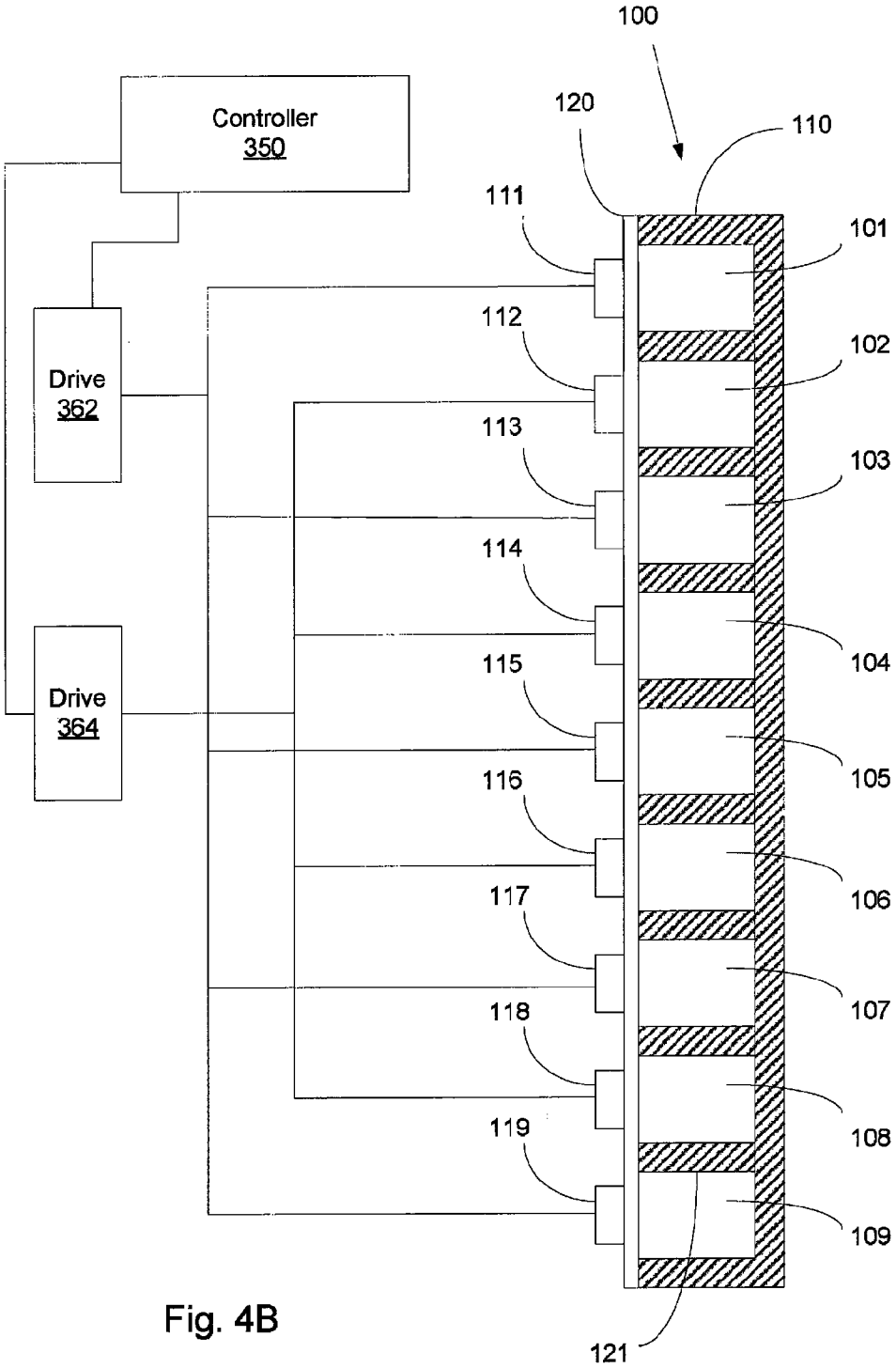
FIG. 4B illustrates a control scheme for operating groups of four adjacent nozzles in an array of a plurality of adjacent nozzles, according to examples.

FIG. 4B illustrates a control scheme for operating groups of four adjacent nozzles in an array of a plurality of adjacent nozzles, according to examples. In one scenario, a driver may separately be assigned to actuate all nozzles that are fired at the same instant (e.g. a driver to drive the first nozzles of each group of adjacent nozzles, another driver to drive the second nozzles of each group of adjacent nozzles, and so on). In the example shown in this figure only two drivers 362 and 364 are provided. According to examples, each driver may used to actuate nozzles separated by one or more nozzles that are actuated by other driver or drivers. In this example each driver is used to actuate of nozzles separated by one nozzle that is actuated by the other driver, in a staggered configuration.

However, as the adjacent nozzles are grouped in fours, the drivers may be configured to separately actuate nozzles they drive.

Figure 4C:
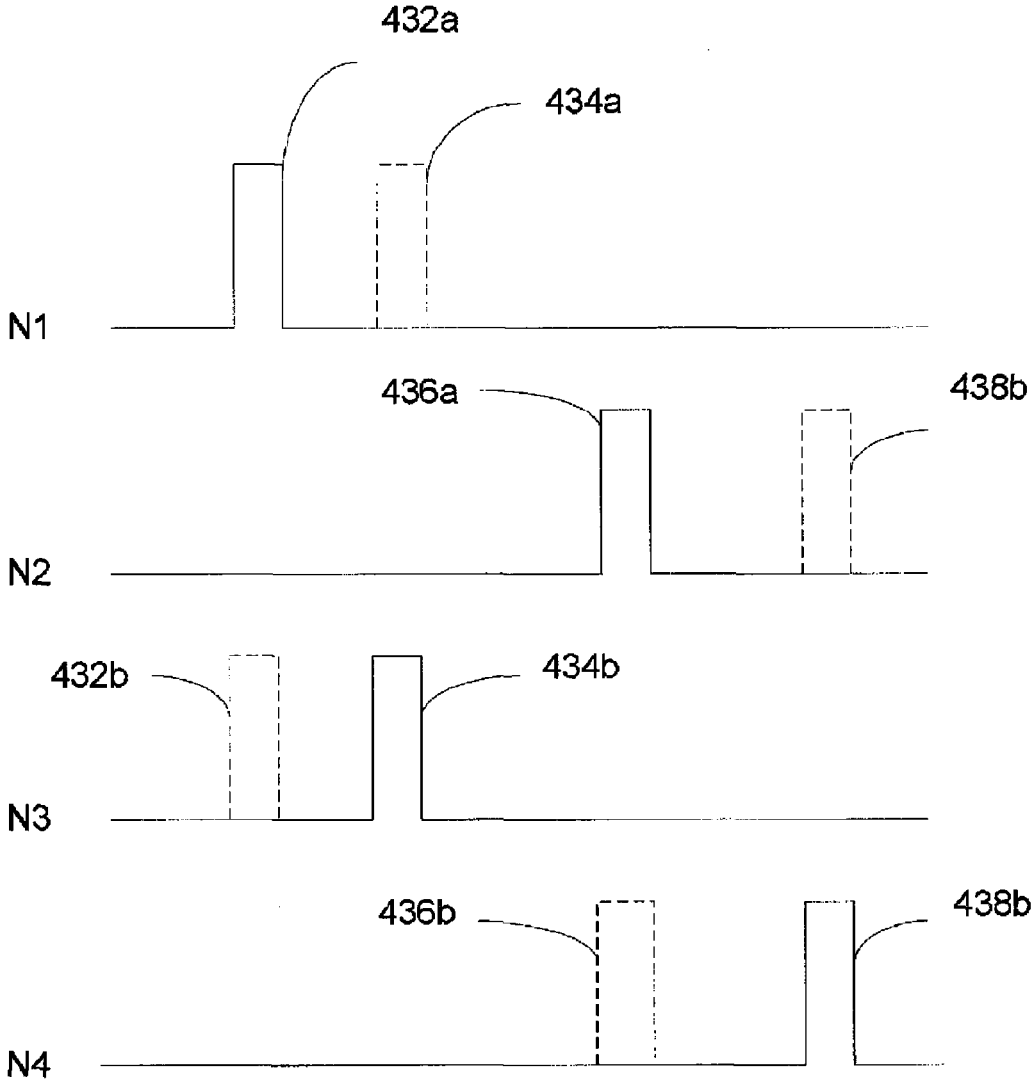
FIG. 4C illustrates an actuation pulse pattern for a group of four adjacent nozzles in an array of a plurality of adjacent nozzles, employing only two drivers, according to examples.

FIG. 4C illustrates an actuation pulse pattern for a group of four adjacent nozzles in an array of a plurality of adjacent nozzles, driven by only two drivers, according to examples. This may be accomplished, for example, in the following manner: a first driver is caused to generate twin actuation pulses 432 and 434—two separate actuation pulses to all the nozzles N1 and N3 connected to that driver (e.g. driver 362 connected to the odd numbered nozzles, 111, 113, 115, 117, 119—see FIG. 4B), while the second driver is caused to generate additional twin pulses 436 and 438—two separate actuation pulses (also separate from the previously mentioned twin pulses generated by the first driver) to all the nozzles N2 and N4 connected to that driver (e.g. driver 364 connected to the even numbered nozzles, 112, 114, 116, 118—see FIG. 4B).

However, in order to avoid double simultaneous actuation of nozzles in the same group of adjacent nozzles, the first pulse 432*b* of the twin pulses of each driver is masked for a subgroup of nozzles driven by that driver so as not to fire the nozzles of that subgroup (e.g. actuators 111, 115 and 119 in FIG. 4B driven by driver 362), while actuation pulse 432*a* is left uninterrupted to actuate the nozzles of the other subgroup (e.g. actuators 113, 117 in FIG. 4B also driven by driver 362 in FIG. 4B) and vice versa (with pulses 434*a* and 434*b* and their corresponding nozzles driven by driver 362 shown in FIG. 4B).

Similarly, in order to avoid double simultaneous actuation of nozzles in the same group of adjacent nozzles, the first pulse 436*b* of the twin pulses of each driver is masked for a subgroup of nozzles driven by that driver so as not to fire the nozzles of that subgroup (e.g. actuators 112, 116 in FIG. 4B driven by driver 364), while actuation pulse 436*a* is left uninterrupted to actuate the nozzles of the other subgroup (e.g. actuators 114, 118 in FIG. 4B) and vice versa (with pulses 438*a* and 438*b* and their corresponding nozzles driven by driver 364 shown in FIG. 4B).

Figure 5:
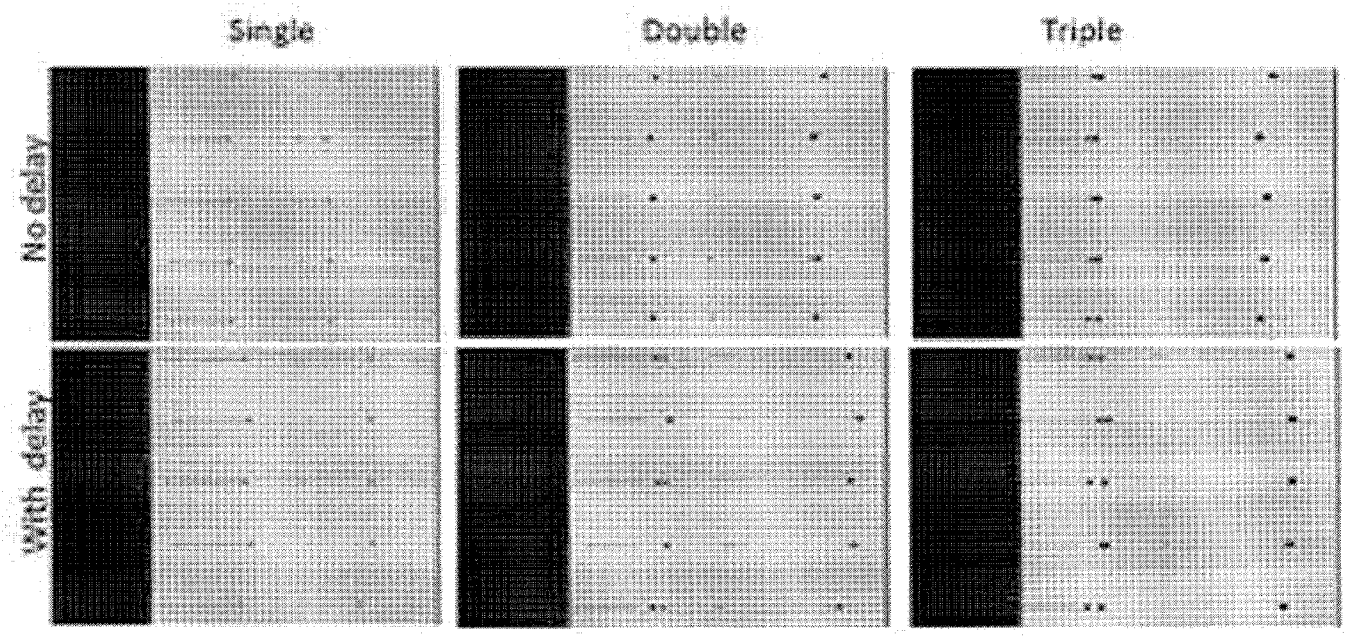
FIG. 5 shows photographed images of single, double and triple droplets in flight with and without cross-talk suppression according to examples.

FIG. 5 shows photographed images of single, double and triple droplets in flight with and without cross-talk suppression according to examples. The images where acquired using a stroboscope. The black block on the left of each image is the printhead, and the dots are ink droplets. The horizontal lines are tails of ink. The top row of images shows (from left to right) single, double and triple driplets ejected from a printhead upon simultaneous actuation of the printhead nozzles, whereas the bottom row of images shows (from left to right) single, double and triple driplets ejected from a printhead upon actuation of the printhead nozzles with delays, according to examples.

"Single", "double" and "triple" refer to the size of the ink droplets produced. It is possible to control the size of the ink droplets by controlling the velocity of the ink exiting the nozzle, the greater the velocity the smaller the droplet and the smaller the velocity the greater the droplet.

Figure 6:
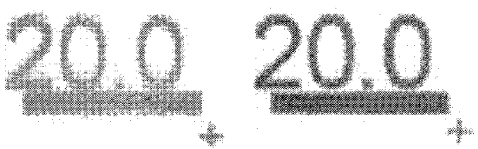
FIG. 6 illustrates the effect of cross-talk suppression according to examples on a printed text.

FIG. 6 illustrates the effect of cross-talk suppression according to examples on a printed text. The printout of "20.0" on the left was printed by a printhead with adjacent nozzles that are simultaneously actuated upon a print pulse, whereas the printout of "20.0" on the right was printed by a printhead with adjacent nozzles that upon a print pulse are actuated with a delay, according to examples.

Examples may be embodied in the form of a system, a method or a computer program product. Similarly, examples may be embodied as hardware, software or a combination of both. Examples may be embodied as a computer program product saved on one or more non-transitory computer readable medium (or media) in the form of computer readable program code embodied thereon. Such non-transitory computer readable medium may include instructions that when executed cause a processor to execute method steps in accordance with examples. In some examples the instructions stores on the computer readable medium may be in the form of an installed application and in the form of an installation package.

Such instructions may be, for example, loaded by one or more processors and get executed.

For example, the computer readable medium may be a non-transitory computer readable storage medium. A non-transitory computer readable storage medium may be, for example, an electronic, optical, magnetic, electromagnetic, infrared, or semiconductor system, apparatus, or device, or any combination thereof.

Computer program code may be written in any suitable programming language. The program code may execute on a single computer system, or on a plurality of computer systems.

Examples are described hereinabove with reference to flowcharts and/or block diagrams depicting methods, systems and computer program products according to various embodiments.

Features of various examples discussed herein may be used with other embodiments discussed herein. The foregoing description of the embodiments has been presented for the purposes of illustration and description. It is not intended to be exhaustive or limiting to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes that fall within the true spirit of the disclosure.

The invention claimed is:

1. A method of cross-talk suppression of adjacent inkjet nozzles, the method comprising:

receiving a print pulse to simultaneously fire ink from an array of adjacent nozzles of an inkjet printhead, said array of adjacent nozzles being divided into a number of different groups, each group containing multiple nozzles and each group having an equal number of nozzles; and actuating corresponding nozzles in different groups of nozzles simultaneously until all nozzles have been actuated, with a time delay between the simultaneous actuations of corresponding nozzles from different groups.

2. The method of claim 1 wherein the time delay is constant.

3. The method claim 1, wherein the time delay varies.

4. The method of claim 1, wherein the time delay satisfies the relation:

$$d=1/(f\,n\,k),$$

where d is the time delay, n is the number of adjacent nozzles in each of the groups, f is a firing frequency of each of the nozzles and k is greater than 1.

5. The method of claim 1, wherein a length of the time delay is chosen taking into account a relative velocity between the array of nozzles and a substrate on which the array of adjacent nozzle is to print.

6. The method of claim 1 wherein the array of adjacent nozzles is arranged in a linear configuration.

7. The method of claim wherein said groups of nozzles each comprises at least three nozzles.

8. The method of claim 1, wherein a firing order of the nozzles of each of the groups is different than a position order of the nozzles of that group.

9. The method of claim 1, further comprising actuating corresponding nozzles in the groups in an order other than an order of position within the group, such that, within a single group, after a first nozzle is actuated, the next nozzle actuated is not positioned next to the first nozzle.

10. A system comprising:

an array of nozzles of an inkjet printhead, said nozzles being divided into a number of different groups of adjacent nozzles, each group containing multiple nozzles and each group having an equal number of nozzles; and a controller to actuate corresponding nozzles in different groups of nozzles simultaneously until all nozzles have been actuated with a time delay between the simultaneous actuations of corresponding nozzles from different groups.

11. The system of claim 10, wherein said groups of nozzles each comprises at least three adjacent nozzles.

12. The system of claim 10, wherein the time delay satisfies the relation:

$$d=1/(f\,n\,k),$$

where d is the time delay, n is the number of adjacent nozzles in each of the groups, f is a firing frequency of each of the nozzles and k is greater than 1.

13. The system of claim 10, wherein the controller comprises multiple drivers, each driver to drive corresponding nozzles in each of the different groups.

14. The system of claim 13, wherein adjacent nozzles driven by each of the drivers are arranged in a staggered configuration.

15. The system of claim 10, the controller to:

actuate a first nozzle in each group simultaneously, each of the first nozzles actuated occupying a same position within its respective group;

waiting for the time delay; and actuate a second nozzle in each group simultaneously, each of the second nozzles actuated occupying a same position within its respective group.

16. The system of claim 10, the controller to actuate corresponding nozzles in the groups in an order other than an order of position within the group, such that, within a single group, after a first nozzle is actuated, the next nozzle actuated is not positioned next to the first nozzle.

17. The system of claim 10, wherein each group comprises at least four nozzles.

18. A system comprising:

an array of adjacent nozzles of an inkjet printhead configured, upon receiving a print pulse to simultaneously fire ink from the array of adjacent nozzles, to actuate groups of three or more adjacent nozzles of said array of nozzles with a time delay between actuations of said three or more nozzles of the groups; and controllers for separately driving different adjacent nozzles in each of the groups, and wherein each of the controllers is configured to drive corresponding nozzles in each of the groups, wherein each controller is configured to drive more than one nozzle in each of the groups.

19. The system of claim 18, wherein each of the controllers is configured to generate simultaneous actuation signals to said more than one nozzle in each of the groups, while masking some of said actuation signals, so as to avoid simultaneous actuation of said more than one nozzles.

20. The method of claim 1, further comprising:

actuating a first nozzle in each group simultaneously, each of the first nozzles actuated occupying a same position within its respective group;

waiting for the time delay; and actuating a second nozzle in each group simultaneously, each of the second nozzles actuated occupying a same position within its respective group.

* * * * *